United States Patent [19]

Rohner

[11] Patent Number: 4,630,782

[45] Date of Patent: Dec. 23, 1986

[54] METHOD AND APPARATUS FOR FORMING A THREAD RESERVE FROM THE THREAD END OF A TEXTILE COIL

[75] Inventor: Joachim Rohner, Monchen-Gladbach, Fed. Rep. of Germany

[73] Assignee: W. Schlafhorst & Co., Monchen-Gladbach, Fed. Rep. of Germany

[21] Appl. No.: 775,715

[22] Filed: Sep. 16, 1985

Related U.S. Application Data

[63] Continuation of Ser. No. 683,967, Dec. 20, 1984, abandoned, which is a continuation of Ser. No. 556,066, Nov. 29, 1983, abandoned, which is a continuation of Ser. No. 426,692, Sep. 29, 1982, abandoned, which is a continuation of Ser. No. 789,622, Apr. 21, 1977, abandoned, which is a continuation-in-part of Ser. No. 658,883, Feb. 18, 1976, abandoned.

[30] Foreign Application Priority Data

Feb. 19, 1975 [DE] Fed. Rep. of Germany ..... 2506930

[51] Int. Cl.[4] ..... B65H 54/02

[52] U.S. Cl. ..... 242/18 EW; 242/18 R; 242/35.5 R; 242/35.6 R

[58] Field of Search ..... 242/18 EW, 18 R, 35.5 R, 242/35.5 A, 35.6 R, 35.6 EW

[56] References Cited

U.S. PATENT DOCUMENTS

| | | | |
|---|---|---|---|
| 3,029,031 | 4/1962 | Furst | 242/35.6 R |
| 3,037,715 | 6/1962 | Higgins | 242/18 R |
| 3,043,529 | 7/1962 | Furst | 242/35.6 R |
| 3,279,712 | 10/1966 | Furst | 242/35.5 R |
| 3,295,775 | 1/1967 | Raasch et al. | 242/35.5 R |
| 3,544,018 | 12/1970 | Stoppard et al. | 242/35.6 R |
| 3,563,478 | 2/1971 | Bell | 242/35.6 R |
| 3,727,852 | 3/1973 | Nelson et al. | 242/35.6 R |
| 3,850,377 | 11/1974 | Pitts et al. | 242/18 R |

*Primary Examiner*—Stanley N. Gilreath

*Attorney, Agent, or Firm*—Herbert L. Lerner; Laurence A. Greenberg

[57] ABSTRACT

A textile thread winding operation, includes a method of forming a thread reserve from the thread end of a textile coil wound on a hollow coil core which comprises removing a textile coil from a winding device and slowly rotating the textile coil in direction opposite to the direction in which a thread is wound thereon, pneumatically seizing a thread end of the textile coil with a suction gripper and sucking the thread end into the suction gripper, displacing the suction gripper so that the suction opening thereof is located at the end of the coil core extending out of the textile coil, and releasing the thread end at the coil core.

8 Claims, 5 Drawing Figures

57
55
555
554
556
557
56
551
553
558
59
552
426
45
64
425
427
424
428
42
421
422
423
44
34
473
462
464
466
46
461
469
470
472
468
63
232
231
16
25
233
463
465
467
471
23
60
602
603
29
30
604
601
22
402
403
40
401
505
39
504
100
50
501
211
20
48
482
152
18
502
503
151
481
483
532
33
53
531
15
17
21
54
34
368
367
36
361
17
171
211
21
362
369
366
213
364
355
18
35
363
365
212
15
351
353
352
354

METHOD AND APPARATUS FOR FORMING A THREAD RESERVE FROM THE THREAD END OF A TEXTILE COIL

This is a continuation of application Ser. No. 683,967 filed Dec. 20, 1984, now abandoned, which is a continuation of application Ser. No. 556,066 filed Nov. 29, 1983, now abandoned, which is a continuation of application Ser. No. 426,692 filed Sept. 29, 1982, now abandoned, which is a continuation of application Ser. No. 789,622 filed Apr. 21, 1977, now abandoned, which is a continuation-in-part of application Ser. No. 658,883 filed Feb. 18, 1976, now abandoned.

The invention relates to a method of forming a thread reserve from the thread end of a textile coil, in connection with a thread winding operation, and apparatus for performing the method.

For many purposes, it is advantageous to have the thread end of a textile coil, such as a cross-wound coil or cheese, especially, available always at a specific location and not to have to search for it each time. The thread end should advantageously not be too short in length and should form a small "thread reserve".

It is an object of the invention to provide a method and apparatus for producing such a thread reserve automatically in a simple and economical manner.

With the foregoing and other objects in view there is provided in accordance with the invention, in a textile thread winding operation, a method of forming a thread reserve from the thread end of a textile coil wound on a hollow coil core which comprises removing a textile coil from a winding device and slowly rotating the textile coil in direction opposite to the direction in which a thread is wound thereon, pneumatically seizing a thread end of the textile coil with a suction gripper and sucking the thread end into the suction gripper, displacing the suction gripper such as by pivoting the same so that the suction opening thereof is located at the end of the coil core extending out of the textile coil, and releasing the thread end at he coil core.

The end of the coil core or the coil core per se is viewed as a preferred location for holding the thread reserve in made-ready condition. For example, the thread end can be wound around the core end. Therefore, in accordance with another mode of the invention, the method includes withdrawing the thread end from the suction gripper and winding the thread end around the coil core, and again rotating the textile coil in the direction in which the thread is wound thereon while the suction gripper is held stationary at the end of the coil core.

Since the thread reserve can also be held in made-ready condition within the hollow interior of the coil core, the method of the invention, in accordance with an alternate mode thereof, includes blowing the thread end out of the suction gripper into the hollow coil core.

In accordance with yet another feature of the invention, the blowing of the thread end into the hollow coil core is effected by reversing the flow direction of air in the suction gripper. It is unnecessary at that time to rotate the textile coil in the direction in which the thread is wound thereon.

In accordance with the apparatus of the invention for carrying out the method, there are provided coil counter-rotating means, and a pivotable and axially shiftable suction gripper means connected with the coil counter-rotating means for seeking, pneumatically gripping and releasing the thread end of the textile coil.

In accordance with another feature of the invention, the suction gripper means of the apparatus has a suction opening and is displaceable from a thread seeking position thereof wherein the suction opening is located in vicinity of the periphery of the textile coil to a thread releasing position thereof wherein the suction opening is located at an end of the coil core extending out of the textile coil.

In accordance with a further feature of the invention, and for the purpose of winding the thread reserve on the end of the coil core, rotating means are provided in connection with the coil counter-rotating means for rotating the textile coil in the direction in which the thread is wound thereon.

In accordance with an additional feature of the invention and, inasmuch as the thread reserve should be held in made-ready condition within the hollow interior of the coil core, the suction gripper means includes a device for reversing the direction of flow of air therethrough. Accordingly, the aforementioned rotating device for rotation of the textile coil in the direction in which the thread is wound thereon is advantageously dispensed with.

In accordance with yet another feature of the invention, the suction gripper means includes a device for reversing the direction of flow of air therethrough so as to blow the thread end into the hollow coil core, and a screen located at the other end of the coil core facing away from the suction opening and in connection with the counter-rotating means or with the coil core for retaining in the coil core the thread end blown into the same.

Of course, every coil core need not necessarily receive a screen. It is sufficient if the end of the coil core out of which the air is blown is covered only in passing by a screen.

Most suitably, the formation of the thread reserve is produced in equal connection with the winding device of the coil. To increase the speed of the winding operation itself, the thread reserve can also, however, be formed later after the wound coils have been removed from the winding device. In such case, each thread end must be sought for anew each time, after the ends of several coils have possibly inadvertently been connected to one another. An exceptionally fully effective suction device and additional thread shears are accordingly surely indispensible.

Thus, the invention of the instant application affords reliable thread reserve formation with the aid of uncomplicated pneumatic devices.

Other features which are considered as characteristic for the invention are set forth in the appended claims.

Although the invention is illustrated and described herein as embodied in method and apparatus for forming a thread reserve from the thread end of a textile coil, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawings in which.

Figure 1:
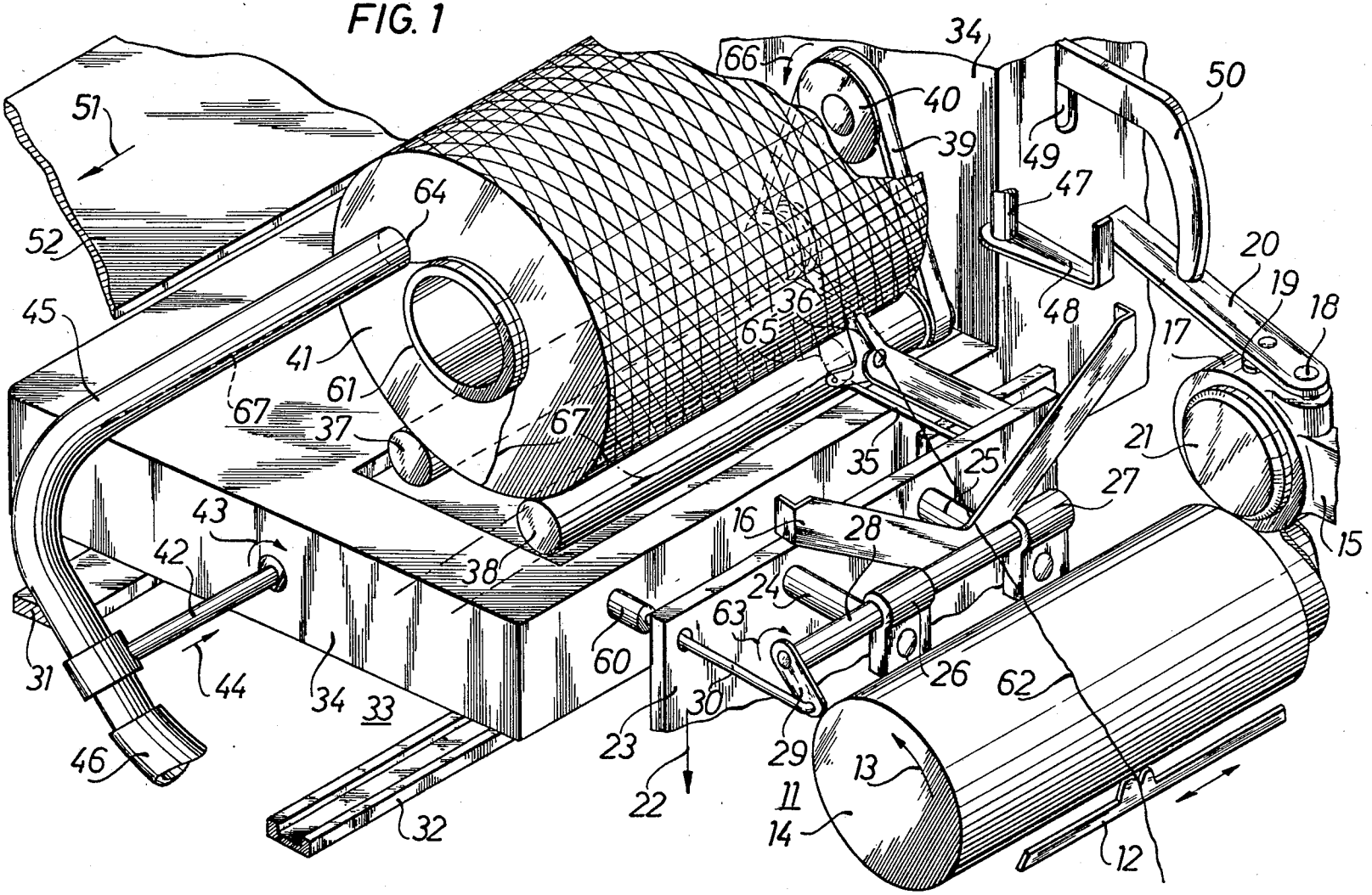
FIG. 1 is a perspective view of part of a coil winding machine showing the apparatus for forming a thread reserve from the thread end of a textile coil in accordance with the invention.

Referring now to the drawing and first, particularly, to FIG. 1 thereof, there is shown in a textile coil winding machine, a winding device 11 having a reciprocating thread guide 12, a winding cylinder or roller 14 rotating in direction of the arrow 13, a coil holder 15 and a coil fork 16.

The coil holder 15 has a head 17 to which a pin 18 is fastened, a control lever 20 provided with a control pin 19 being, in turn, rotatably fastened to the pin 18. The control lever 20 serves to engage and disengage a coil-core take-up member 21 which is rotatably and longitudinally displaceably mounted in the head 17. A plate 23 lowerable in direction of the arrow 22 is provided with two pins 24 and 25 to which respective shaft bearings 26 and 27 are fastened. A shaft 28 is mounted in the bearings 26 and 27 and is connected to the coil fork 16. A lever 29 extends from the shaft 28 and is articulatingly secured at the end thereof to a control rod 30.

A coil removing device 33 travels on rails 31 and 32 behind the winding device 11. The coil removing device 33 has a housing 34 which contains otherwise non-illustrated program switching or controlling devices, drive mechanisms and a travel device, that do not of themselves form any part of the invention and are of conventional construction. Thread gripping or clamping shears 36 actuatable by a control rod 35 are fastened laterally to the housing 34. Furthermore, two rollers 37 and 38 are disposed in a recess formed in the housing 34 and are driveable by a V-belt 39 through a belt pulley 40. A textile coil 41 previously removed from the winding device 11 is mounted on the rollers 37 and 38.

A control rod 42, projecting from the housing 34 of the coil removing device 33, is rotatable in direction of the arrow 43 and is longitudinally shiftable in direction of the arrow 44. A suction gripper 45 is fastened to the control rod 42 and has a flexible line connector 46.

A bent control lever 48 is secured to a shaft 47 projecting from the housing 34. A control lever 50 projects from a slot 49 formed in the housing 34. With the aid of the control lever 48, the coil-core take-up member 21 can be disengaged and engaged and, by means of the control lever 50, the coil holder 15 can be lowered. The control rod 30 is actuatable by means of a plunger 60 projecting from the housing 34.

A conveyor belt 52 is moved in direction of the arrow 51 at the rear side of the coil removing device 33.

Figure 2:
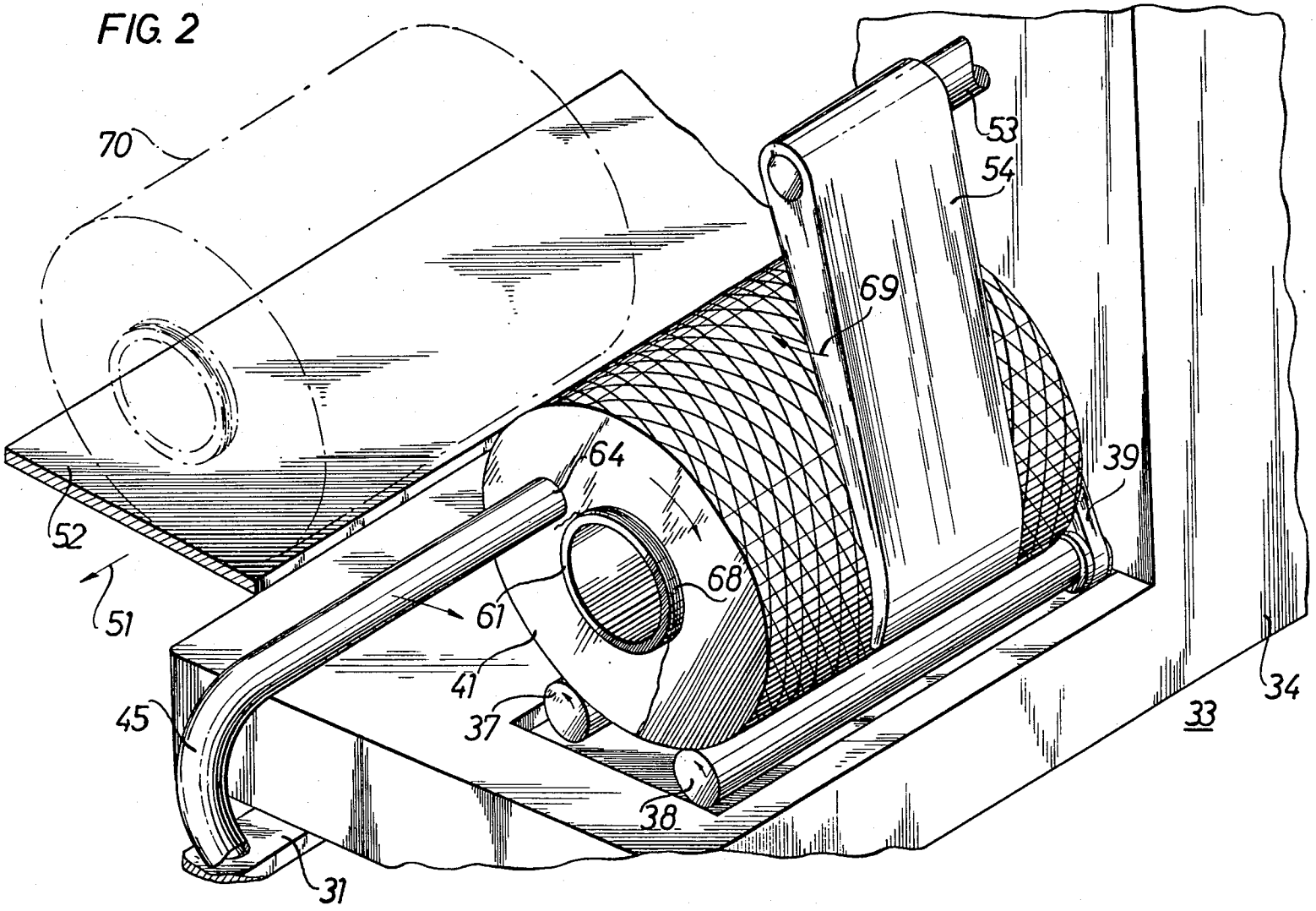
FIG. 2 is a fragmentary perspective view of FIG. 1 showing various features of the apparatus in greater detail.
Figure 3:
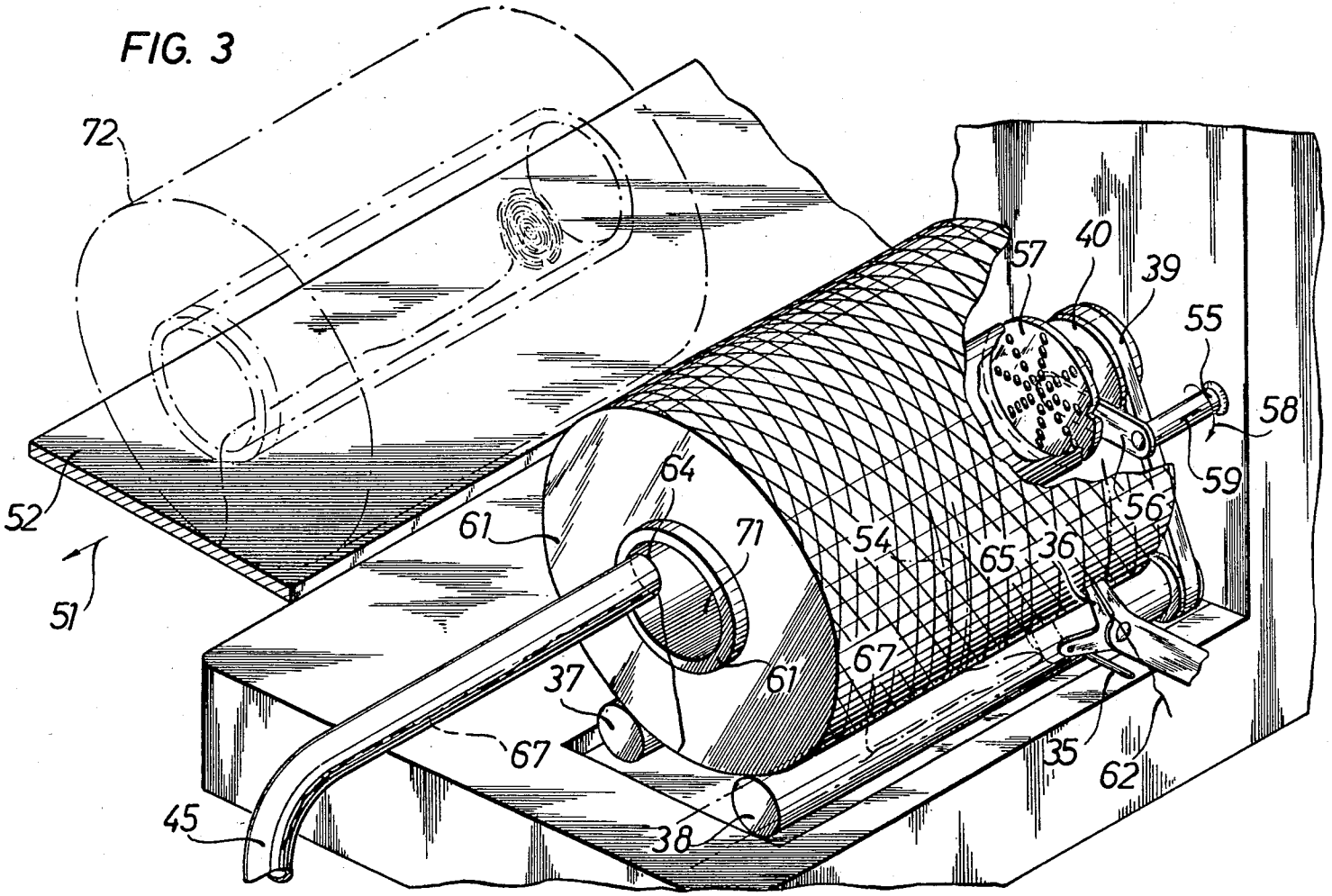
FIG. 3 is a fragmentary perspective view similar to that of FIG. 2 of another embodiment of the invention.

In FIG. 2, there is furthermore shown a shaft 53 projecting from the housing 34 of the coil removing device 33 and having a coil ejector 54 fastened thereto. In FIG. 3, there is additionally illustrated a shaft 55 projecting from the housing 34 and having attached, at the end thereof, a lever 56 which carries a sieve or screen 57. The shaft 55 is rotatable in direction of the arrow 58 and is longitudinally displaceable in direction of the arrow 59.

Before a new textile coil 41 assumed the position thereof on the rollers 37 and 38, as shown in FIG. 1, the hollow coil core 61 thereof was previously stuck onto the coil-core take-up member 21, which had been actuated for this purpose and accordingly extended in a manner to receive the take-up member 21 thereon. Actuation and inactivation of the coil-core take-up member 21 is effected by means of the control lever 20. For this purpose, as shown in the circuit diagram of FIG. 4, the control lever 20, which is pivotally mounted by the pin 18 on the head 17 of the coil holder 15, is provided with a pin 211 (also note the detailed view of FIG. 5) that projects through a slot 171 formed in the head 17 into a guiding groove 213 formed in the coil-core take-up member 21. If the pin 211 is then moved by the control lever 20 in direction of the arrow 212 (FIG. 5), it entrains the coil-core take-up member 21 in the same direction. If the pin 211 is moved in direction opposite that of the arrow 212, the coil-core take-up member 21 is forcibly moved in the same direction.

Figures 4, 5:
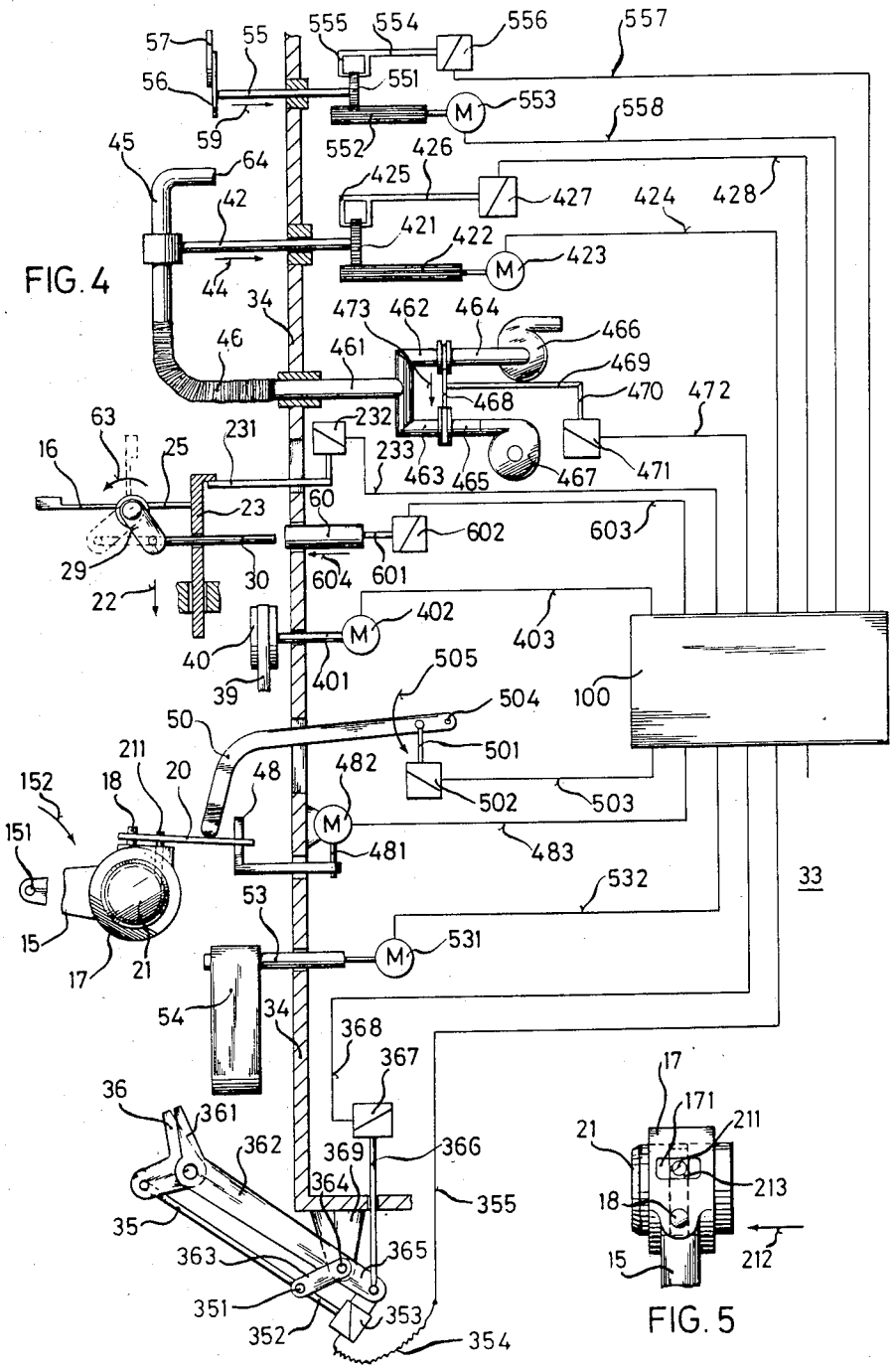
FIG. 4 is a partly diagrammatic and schematic sectional view of the apparatus of the invention showing especially the means by which the coil removing device actuates the various parts of the apparatus.
FIG. 5 is a fragmentary side elevational view, with the control lever 20 removed, of the coil-core take-up member showing various details thereof.

The textile coil 41 lay previously on the winding cylinder 14 shown in FIG. 1 and was set into rotation by friction. When the predetermined fullness of the coil 41 was attained, further feed of the thread 62 was initially stopped. With the approach of the coil-removing device 33 to the winding device 11, the coil fork 16 is initially actuated in the following manner:

Due to rotation of the lever 29 in direction of the arrow 63 with simultaneous lifting of the plate 23 in direction opposite that of the arrow 22, the coil fork 16 is shoved between the winding cylinder 14 and the textile coil 41. The turning of the coil fork 16 in direction of the arrow 63 is effected due to the weight of the coil fork 16 per se. The lifting of the plate 23 is effected, on the other hand, by an electromagnetic drive 232 having a control rod 231 which engages beneath a projection of the plate 23. The electromagnetic drive 232 is connected by a line 233 to an electrical switching or controlling device 100. In this regard, it is noted that the switching device 100, as shown in FIG. 4, not only actuates or inactivates i.e. switches on and off, the electromagnetic drive 232 but also similarly controls other hereinafter-described drives of the apparatus of the invention, that are connected thereto, in accordance with a selected switching program which has not been otherwise illustrated or explained because such electric switching programs are well known in the art and are consequently readily designable without experimentation and form no specific part of the invention in this application since they may be of any suitable conventional form.

Thereafter, the plunger 60 was actuated and brought the coil fork 16 into the position thereof shown in FIG. 1. This occurred by means of an electromagnetic drive 602 which is connected by a line 603 to the switching device 100. When the electromagnetic drive 602 is switched on or activated, the plunger 60 is pushed forward or advanced in direction of the arrow 604 by an actuating rod 601. The control rod 30 located in front of the plunger 60 is thereby pushed forward to such an extent that the lever 29 and the coil fork 16 assume the positions thereof shown in broken lines in FIG. 4. Due to this movement of the coil fork 16, the textile coil 41 rolls onto the rollers 37 and 38 of the coil-removing device 33 as shown in FIG. 1.

Since the coil fork 16 has a V-shaped construction, it then assumes the guidance of the thread 62 which remains connected, for the time being, to the textile coil 41.

During the entire course of operation, the opening 64 of the suction gripper or sucker 45 was located in the position 65 thereof shown in phantom in FIG. 1 or, in other words, was disposed directly in front of the thread 62.

After the textile coil 41 was taken-over by the coil-removing device 33, the belt pulley 40 was rotated slowly in direction opposite that of the arrow 66 in FIG. 1, and the suction gripper 45 was subjected to negative pressure or suction through the flexible line connector 46. The rotation of the belt pulley 40 is provided by a motor 402 which is connected by a line 403 to the switching device 100. The belt pulley 40 is seated on a shaft 401 of the motor 402. The flexible line connector 46 is continued in a tube 461 within the housing 34 of the coil-removing device 33, the tube 461 having bifurcations 462 and 463 in the housing 34. A transverse slot suitable for introducing therein a blocking slider 468 is disposed therebetween. This blocking slider 468 has an actuating rod 469 which is actuatable by a control armature or plunger 470 of an electromagnetic drive 471. The electromagnetic drive 471 is connected by a line 472 to the switching device 100. An exhaustor 466 is located at the end of a tube section 464 connected to one section 462 of the bifurcated tube 461. Located at the end of a tube section 465 connected to the other section 463 of the bifurcated tube 461 is the opening of a blower 467. Between the tube sections 463 and 465 is a transverse slot for introducing the slider 468. If the suction gripper 45 is to be subjected to negative pressure or suction, the slider 468 is shifted or slid by the electromagnet drive 471 in direction of the arrow 473 until a communicating connection is effected between the tube sections 462 and 464, while the tube sections 463 and 465, on the other hand, are blocked from communication with one another.

Rotation of the control shaft 42 in direction of the curved arrow 43 (FIG. 1) is effected by a motor 423 which is connected by a line 424 to the switching device 100. The shaft of the motor 423 carries a cylindrical pinion 422, the teeth of which are in meshing engagement with a gear 421 that is mounted on the control rod 42. Shifting or sliding of the control rod 42 in direction of the arrow 44 or opposite to the direction thereof is provided by an electromagnetic drive 427 which is connected by a line 428 to the switching device 100. The eletromagnetic drive 427 has an actuating rod 426 which carries a fork 425 at an end thereof, the tines of the fork 425 extending on both sides of the gear 421.

After the suction gripper 45 was subjected to negative pressure or suction, the thread 62 was sucked in the form of a loop into the suction gripper 45. The thread clamping shears 36 were then swung upwardly and severed the thread. The thread clamping shears 36 are articulatingly fastened, pivotable scissors-like, to a fixed knife blade 361. The knife blade 361 has a shearing lever 362 that is turnably mounted at a pivot point 364 on a bracket or console 369 of the housing 34. The shearing lever 362 has a continuation or extension 365 engaged by a control rod 366 of an electromagnetic drive 367. The electromagnetic drive 367 is connected by a line 368 to the switching device 100 and provides for the pivoting of the thread clamping shears 36 about the pivot point 364. Another electromagnetic drive 353 is fastened to the extension 365 and has a control rod 352 engaging at the pivot point 351 in a lever 363 pivotable about the pivot point 364. The lever 363 is connected by the control rod 35 to the movable knife blade of the thread clamping shears 36. The electromagnetic drive 353 is connected through a flexible line 354 and a rigid or fixed line 355 connected to the flexible line 354 to the switching device 100 and provides for the opening and closing of the shears 36.

As shown in FIG. 1, the thread end coming from the take-up coil 41 remains in the suction gripper 45, while the thread 62 is firmly held by the clamping shears 36. After completion of the aforedescribed operations or steps, the suction gripper 45 was swung back to the starting position thereof illustrated in FIG. 1. This occurred as mentioned hereinbefore, by means of the motor 423. Since the opening 64, during the backward-swinging movement of the suction gripper 45, passes quite closely by the rear surface of the textile coil 41 and, simultaneously, the belt pulley 40 is connected for reverse operation by switching over or reversing the motor 402 and is rotated in direction of the arrow 66 (FIG. 1), the thread end 67 is deposited in windings about the coil core 61 projecting somewhat out of the textile coil 41. According to FIG. 2, the thread end 67 is shown already wound into a thread reverse 68 in the aforedescribed manner. The coil ejector 54 then becomes operative. The coil ejector 54 is swung in direction of the arrow 69 and thereby throws the textile coil 41 onto the conveyor belt 52 whereon it assumes the position 70 thereof, shown in phantom in FIG. 2, and is accordingly carried away by the conveyor belt 52. At the latest, in this instant, the suction gripper 45 is disconnectible from the non-illustrated negative-pressure or suction source thereof.

The pivoting movement of the coil ejector 54 is provided by an electric motor 531 which is connected by a line 532 to the switching device 100. The shaft 53 of the coil ejector 54 is an extension or elongation of the shaft of the electric motor 531.

The actuation and inactivation i.e. switching on and off, of the coil-core take-up member 21 by the control lever 20 occurs by means of a geared motor 482 which is connected by a line 483 to the switching device 100. The bent control lever 48 is seated on the shaft 481 of the geared motor 482. During rotation of the shaft 481, the end of the control lever 48 engages the control lever 20 so that the control lever is rotated about the pin 18. The coil holder 15 can be lowered by means of the control lever 50. The end of the control lever 50 presses against the control lever 20 the instant the control lever 50 is pivoted in direction of the arrow 505 about the articulating pin 504 thereof. This pivoting action is provided by an electromagnetic drive 502 which is connected by a line 503 to the switching device 100. The electromagnetic drive 502 has a control lever 501 which is articulatingly connected to the control lever.

Another embodiment of the invention is shown in FIG. 3. After the thread 62 has been severed by the thread clamping shears 36, and the thread end 67 has been sucked into the suction gripper 45, the latter pivots only until it is located in front of the opening 71 of the coil core 61. Simultaneously, the shaft 55 is rotated in direction opposite that of the arrow 58 and is rectilinearly shifted in direction opposite that of the arrow 59, so that the screen 57 engages the end of the coil core 61 facing away from the opening 64 of the suction gripper 45. The rotation of the shaft 55 is effected, as shown in FIG. 4, by a geared motor 553 which is connected to the switching device 100 by a line 558. The shaft of the geared motor 553 carries a cylindrical pinion 552, the teeth of which are in meshing engagement with a gear 551 that is seated on the end of the shaft 55. The rectilinear shifting of the shaft 55 in direction of the arrow 59 or in opposite direction thereof is provided by an electromagnetic drive 556, which is connected by a line 557 to the switching device 100.

The electromagnetic drive 556 has a control rod 554 which carries a fork 555 at the end thereof, the two ends of the fork 555 engaging the gear 551 on both sides thereof.

If the suction-air flow direction is reversed in the suction gripper 45 by shifting the slider 468, and the suction gripper 45 is accordingly subjected to positive or excess pressure, accordingly, by the blower 467, as shown in FIG. 4, the entire thread end 67 is then blown into the hollow coil core 61. The screen 57 (FIG. 3) retains the thread end 67 in the coil core 61. After the screen 57 has been brought back again into the initial position thereof by shifting the shaft 55 in direction of the arrow 59 and by rotating the shaft 55 in direction of the arrow 58 by means of the geared motor 553 and the electromagnetic drive 556, respectively, the coil ejector 54, driven by the motor 531, is actuated and throws the textile coil 41 onto the conveyor belt 52 where it assumes the position 72 thereof shown in phantom in FIG. 3.

The time sequence and duration of the aforedescribed operations can be ensured by programmed control mechanisms, such as cam disc control or switching mechanisms, for example, which are not further described herein as they are quite conventional and can be readily designed by individuals of ordinary skill in the art. The aforedescribed winding device, as aforementioned, can be part of a very large machine unit such as, for example, a winding machine having a multiplicity of winding stations. The coil removing device can be part of a traveling take-up coil-exchanging device.

There are claimed:

1. A method for forming a thread reserve from a thread end of a textile coil fully wound on a coil core having an end projecting out of the textile coil and frictionally driven by a winding roller in a winding device, which comprises removing the textile coil from the winding device by means of a coil removing device, retaining the coil on the coil removing device, pneumatically seizing a thread extending between the winding roller and the textile coil by means of a suction gripper and sucking the thread in the form of a loop into a mouth of a suction gripper while simultaneously rotating the textile coil in a direction opposite to the direction in which a thread has been previously wound on the coil, severing the thread between the suction gripper and the winding roller by thread clamping shears while firmly holding a thus severed thread end from the winding roller and setting free a thus severed thread end of the textile coil, swinging the mouth of the suction gripper to the end of the coil core projecting out of the textile coil, releasing the thread end at the coil core, and disposing a length of the thread end of the textile coil as a thread reserve on the coil core.

2. Method according to claim 1 wherein releasing the thread end comprises withdrawing the thread end from the suction gripper, and disposing the thread length as a thread reserve comprises winding the thread end around the coil core, and again rotating the coil in the direction in which the thread is wound thereon while the suction gripper is held stationary at the end of the coil core.

3. Method according to claim 1 wherein the coil core is hollow, and disposing the thread length as a thread reserve includes blowing the thread end into the hollow coil core.

4. In a winding machine, a cop-readying apparatus for performing a method of forming a thread reserve from a thread end of a textile coil fully wound and frictionally driven by a winding roller in a winding device, comprising a coil removing device having coil counter-rotating means for rotating the coil counter to a direction in which a thread has been previously wound on the coil, so as to unwind a given length of the thread, suction gripper means disposed adjacent said coil counter-rotating means and having a mouth variable in position thereof from a thread suction location, at which the given thread length extending from the winding roller to the textile coil previously removed by the coil removing device from the winding device is disposed, to a thread delivery location in vicinity of an end of a coil core of the textile coil, thread clamping shears disposed between said thread suction location and said winding roller, said thread clamping shears being actuatable by said coil removing device for severing said given thread length while firmly holding a thus formed thread end from the winding roller and setting free a thus formed thread end of the textile coil and means including said suction gripper means for disposing a length of the thread end of the textile coil as a thread reserve on the coil core.

5. Apparatus according to claim 4 wherein the coil core is hollow, and the hollow-coil core has an end thereof extending out of the coil, and said means including said suction gripper means also include rotating means for rotating the coil in the direction in which the thread is wound thereon to form a thread reserve on the end of the hollow coil core.

6. Apparatus according to claim 4 wherein the coil core is hollow, and said suction gripper means includes a device for blowing the thread end into the hollow coil core.

7. Apparatus according to claim 4 wherein the coil core is hollow, and wherein said suction gripper means include a device for blowing the thread end into the hollow coil core, and including a screen located at the other end of the coil core facing away from the blowing device for retaining in the hollow-coil core the thread end blown into the same.

8. Cop-readying apparatus according to claim 4 wherein said suction gripper means are pivotable and axially shiftable.

* * * * *